US007946455B2

(12) United States Patent
Ritsche et al.

(10) Patent No.: US 7,946,455 B2
(45) Date of Patent: May 24, 2011

(54) METERING DEVICE FOR AT LEAST ONE MEDIUM

(75) Inventors: Stefan Ritsche, Eigeltingen (DE); Karl Tempfli, Gottmadingen (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 1071 days.

(21) Appl. No.: 11/665,128

(22) PCT Filed: Oct. 6, 2005

(86) PCT No.: PCT/EP2005/010745

§ 371 (c)(1),
(2), (4) Date: Apr. 11, 2007

(87) PCT Pub. No.: WO2006/042641

PCT Pub. Date: Apr. 27, 2006

(65) Prior Publication Data

US 2008/0035223 A1 Feb. 14, 2008

(30) Foreign Application Priority Data

Oct. 14, 2004 (DE) ..... 10 2004 050 977

(51) Int. Cl.
*B05B 11/02* (2006.01)

(52) U.S. Cl. ..... 222/321.6; 222/321.8; 222/481

(58) Field of Classification Search .... 222/321.6–321.9, 222/373, 378, 383.1, 383.3, 385, 481
See application file for complete search history.

(56) References Cited

U.S. PATENT DOCUMENTS

| | | | | |
|---|---|---|---|---|
| 4,153,203 | A | 5/1979 | Tada | |
| 4,435,135 | A | 3/1984 | Knickerbocker | |
| 4,694,976 | A | 9/1987 | Schuetz | |
| 5,271,532 | A | 12/1993 | Jumel et al. | |
| 5,425,477 | A * | 6/1995 | Montaner et al. | 222/383.1 |
| 6,279,785 | B1 | 8/2001 | Bonningue | |
| 7,066,358 | B2 | 6/2006 | Monsalve et al. | |
| 2004/0000567 | A1 | 1/2004 | Greiner-Perth | |

FOREIGN PATENT DOCUMENTS

| | | |
|---|---|---|
| DE | 26 29 572 | 1/1978 |
| DE | 34 29 835 A1 | 2/1986 |
| DE | 35 03 354 A1 | 8/1986 |
| DE | 44 38 364 A1 | 5/1996 |
| DE | 102 20 557 A1 | 11/2003 |
| EP | 0 062 341 | 10/1982 |
| EP | 0 689 877 A2 | 1/1996 |
| WO | WO 01/39893 A1 | 6/2001 |

OTHER PUBLICATIONS

International Search Report dated Feb. 2, 2006 (4 pages).
Written Opinion of International Searching Authority (5 pages).
German Patent Office Search Report dated Aug. 24, 2005 (4 pages).

* cited by examiner

*Primary Examiner* — J. Casimer Jacyna
(74) *Attorney, Agent, or Firm* — Flynn, Theil, Boutell & Tanis, P.C.

(57) ABSTRACT

A metering device is provided for metering at least one medium. The metering device includes a medium storage unit and a pumping system connected to the medium storage unit. The medium storage unit or the pumping system has a venting valve which is elastically held in the closed position. The metering device also includes a control member associated with the venting valve in such a way that the control member opens the venting valve as a result of a pumping movement of the pumping system.

9 Claims, 4 Drawing Sheets

METERING DEVICE FOR AT LEAST ONE MEDIUM

FIELD OF THE INVENTION

The invention relates to a metering device for at least one medium, with a medium storage unit, and with a pumping system connected to the medium storage unit, said medium storage unit or said pumping system comprising a venting valve that is held in the closed position by elastic force.

BACKGROUND OF THE INVENTION

A venting valve loaded by elastic force is to be understood both as a venting valve that is movable and restorable by virtue of elastic deformation properties and is composed at least partially of an elastomer material, and as an elastic force applied by an external spring arrangement. A metering device of this kind is used for the metering of liquid media, gel media and powdered media, or combinations of these. The media can be intended in particular for pharmaceutical or cosmetic applications. The metering device permits dispensing of a predetermined quantity of the medium. An exact metering of the medium may be necessary for pharmaceutical applications.

Document DE 44 38 364 A1 describes a metering device in which a medium storage unit is closed by a pumping system designed as a thrust piston. The pumping system comprises a filling channel, which is also suitable as a venting channel for the medium storage unit. To allow ambient air to flow into the medium storage unit, for example for pressure equalization after medium has been discharged by the pumping system, a venting valve is provided which is designed as an annular seal. This seal at least partially surrounds the pumping system elastically and thus closes the venting channel between the medium storage unit and the environment. In the event of a pressure difference between the medium storage unit and the environment, for example in the event of an underpressure in the medium storage unit, the seal allows ambient air to flow into the medium storage unit by means of an elastic deformation. As soon as the pressure difference falls below a pressure level defined by the elastic properties of the seal, the seal closes the venting channel and thus prevents further admission of ambient air. This procedure takes place whenever a pressure difference exists that can cause an elastic deformation of the seal. This can also take place independently of an actuation of the metering device.

Particularly for pharmaceutical media, it is not only important to meter an exact quantity of the medium, but also to ascertain the amount of active substance metered with the corresponding quantity of medium. In known metering devices, the active substance concentration may very gradually change, particularly if readily volatile, evaporated constituents of the medium escape from the medium storage unit by way of the venting channel. In these circumstances, even with constant metering of the quantity of medium, a change can occur in the metered amount of active substance. A change of this kind in the amount of metered active substance is undesirable in pharmaceutical media.

SUMMARY OF THE INVENTION

The object of the invention is to make available a metering device which, over a long period of time, prevents a change in an active substance concentration of a medium stored in the medium storage unit.

This object is achieved by a metering device of the type mentioned at the outset in which a control member is assigned to the venting valve in such a way that the control member opens the venting valve in the event of a pumping movement of the pumping system. In this way, the venting valve is normally only opened when the pumping system is also actuated. It is thus possible to prevent uncontrolled gas exchange between the volume enclosed in the medium storage unit and the environment. An uncontrolled gas exchange which, in a metering device known from the prior art, takes place as a result of thermal expansion or shrinkage of the volume enclosed in the medium storage unit, and as a result of the associated pressure difference, may lead to the undesired escape of the readily volatile, evaporated constituents of the medium. By means of the venting valve being controlled by the control member, in particular by a mechanical action of the control member on the venting valve, the result achieved is that the venting valve can have characteristics differing from the prior art. In known venting valves, a response to a relatively low pressure difference must be guaranteed. This pressure difference is primarily caused by the discharge of a small quantity of medium from the medium storage unit and requires a sensitive response on the part of the venting valve in order to ensure venting of the medium storage unit and metering accuracy in a new metering operation. By contrast, in the venting valve controlled by the control member, a valve characteristic can be chosen such that the venting valve, without the action of the control member, does not respond, or responds only at very high pressure differences, since the control of the venting valve in a metering operation is ensured by the control member. In this way, it is possible to prevent readily volatile constituents of the medium from escaping from the medium storage unit even at low pressure differences, with the result that the concentration of active substances in the medium remains constant over a long period of time.

In one embodiment of the invention, the venting valve and the control member are provided with mutually corresponding control surfaces that can be brought into contact with one another for a process of opening of the venting valve. An opening process of the venting valve is brought about by a forced control system in which a control surface of the control member interacts with a control surface of the venting valve and thus, by means of a form-fit and/or force-fit engagement, causes the venting valve to deflect from a closed position to an open position. The actuating force required for actuating the venting valve is introduced from the control member to the venting valve via the control surfaces, such that a characteristic of the venting valve can be adapted to the actuating forces introduced to the control member by a operator. Since the actuating forces can be several times greater than the pressure forces that arise in the medium storage unit because of the pressure difference after metering of a quantity of medium, the opening behavior of the venting valve can be set to a considerably higher pressure level compared to known venting valves. It is thus possible to effectively suppress an undesired escape of readily volatile medium constituents from the medium storage unit at low pressure differences, as can happen in known venting valves.

In another embodiment of the invention, the control member is arranged on an actuating part which belongs to the pumping system and which is movable in a reciprocating motion relative to the venting valve, and the venting valve, in the unloaded state of the pumping system, is arranged at an axial distance from the control member (relative to a pump axis) that is smaller than an actuating stroke of the actuating part. This permits a simple construction of the pumping system and of the control member provided thereon. The control member is arranged on the actuating part of the pumping system that is movable in a reciprocating motion and that is provided for actuation of the pumping system. A force is introduced by a user into the pumping system via the actuating part, such that the force applied by the user can also be transmitted directly to the control member. The introduction of the force causes an actuating stroke of the pumping system which, in addition to permitting the metering of the medium, also causes the control surfaces of control member and venting valve to move toward one another and come into mechanical contact, such that, with the actuating stroke, a control of the venting valve is also obtained. To guarantee this, the distance between the control member and the venting valve in an unloaded rest position of the actuating part, in an axial direction of the pumping system, is chosen to be smaller than the actuating stroke. Therefore, as soon as a complete actuating stroke of the actuating part is executed, it is necessarily also guaranteed that the control member comes to interact with the venting valve and causes the venting valve to open.

In another embodiment of the invention, the venting valve is designed as a tubular cuff which, coaxially with respect to the pump axis, encloses a rotationally symmetrical pump section. This permits a particularly simple construction and advantageous operational safety of the venting valve. A rotationally symmetrical pump section can be produced with a high degree of precision by an inexpensive manufacturing method, such as plastic injection molding. In this case, the pump section represents in particular an outer contour of a functional part of the pumping system. A tubular cuff which, in order to guarantee the valve function, can be made of an elastic material, in particular an elastomer such as silicone, rubber, polyethylene or thermoplastic elastomer, is particularly advantageous in respect of a force flow arising in the tubular cuff. This applies both to the force flow that is needed to generate the elastic pretensioning in the rest state, and also to the force flow that arises when the tubular cuff is deflected upon opening of the venting valve. In both cases, the only forces that arise in the tubular cuff, preferably designed as a rotationally symmetrical structural part, are essentially forces that act in a circumferential direction and that can be lead off particularly advantageously by the tubular contour and thus guarantee a precise function and a long service life of the tubular cuff. With such a design of the venting valve, a valve seat representing the sealing surface between the tubular cuff and the pump section can be designed as a pump section surface. By virtue of the flexibility of the tubular cuff, a tolerance compensation is ensured within wide limits, such that the function of the venting valve is guaranteed even in the event of fluctuations in the manufacturing precision of tubular cuff and pump section.

In another embodiment of the invention, the venting valve is arranged to yield axially between a valve-opening position and a valve-closing position, and the control member transfers the venting valve axially into the valve-opening position. The axial yielding of the venting valve can be obtained by a complete axial displacement of the venting valve or simply by an elastic deformation of at least a partial area of the venting valve. An axial movement of the control member, in particular by a pump movement, leads to the desired valve-opening process.

In another embodiment of the invention, the venting valve is designed to be axially elastically deformable, and the venting valve can move back from the valve-opening position to the valve-closing position by virtue of its elastic restoring properties. In its axial movement, the control member exerts on the venting valve, or on a partial section of the venting valve, an axial deformation or compression, until the venting valve is axially displaced such that a corresponding venting path is freed. Upon a corresponding return stroke and a resulting retreat of the control member, the venting valve returns to its starting position and, therefore, to its valve-closing position. This return movement is achieved by the elastic material properties of the venting valve or of a corresponding partial section of the venting valve.

In another embodiment of the invention, the control surfaces are oriented at an inclination with respect to the pump axis in such a way that, during a pumping movement, a radial movement component directed outward from the pump axis is applied to the tubular cuff. By this means, an opening of the venting valve can be brought about in a particularly simple manner. The inclination of the control surfaces with respect to the pump axis introduces a wedging action that causes the tubular cuff to be forced outward. In this way, the tubular cuff is lifted by the cylindrical pump section and frees at least a channel through which ambient air can flow into the medium container. The wedging action occurs particularly advantageously when the control surfaces assume an acute angle with respect to the pump axis.

In another embodiment of the invention, the control surfaces are formed by mutually facing conical-ring surfaces arranged, on the one hand, on the actuating part of the pumping system and, on the other hand, on the tubular cuff. In this way, it is possible to guarantee a uniform transmission of force from the control member to the tubular cuff, because the conical-ring surfaces lead to an interaction between control member and tubular cuff about their entire respective circumference. This ensures a gentle deformation of the tubular cuff and, therefore, a reliable actuation of the venting valve. The conical-ring surfaces of the tubular cuff and of the control member can be identical in respect of a wedge angle relative to the pump axis or can also be designed deviating from one another, in which case the conical-ring surfaces preferably lie opposite one another via their narrow face.

In another embodiment of the invention, the control member or the venting valve is assigned a time control for delayed opening or closing of the venting valve. In this way, it is advantageously possible to influence the time of opening and duration of opening of the venting valve. A time control can be realized in particular by a relative mobility of the control member on the actuating part. In this case, force is transmitted between actuating part and control member via a damping means, for example. This can ensure that a movement of the actuating part for actuation of the pumping system is followed by the control member only after a delay, as a result of which the venting valve is controlled later than in the case where there is a rigid coupling between actuating part and control member. The time delay member can also be configured such that, in addition or alternatively to this, a return stroke of the actuating part, after execution of the pump stroke, is transmitted to the control member only with a delay, with the result that the venting valve is temporarily still open, even though the actuating part has already moved back in the direction of its rest position. By means of the altered opening time and the altered opening duration, it is possible in particular to achieve an especially uniform inflow of ambient gas into the medium container. This permits, for example, the use of a filter system that is provided as a microbe barrier for the medium container. Such a filter system permits, if appropriate, only a limited volumetric flow for the ambient air, which, without influence on the opening duration of the venting valve, would not be sufficient to cause a complete pressure equalization by flow of ambient air through the filter system into the medium storage unit.

BRIEF DESCRIPTION OF THE DRAWINGS

Further advantages and features of the invention are set forth in the claims and will become clear from the following description of a preferred illustrative embodiment of the invention shown in the drawings, in which:

DETAILED DESCRIPTION

Figure 1:
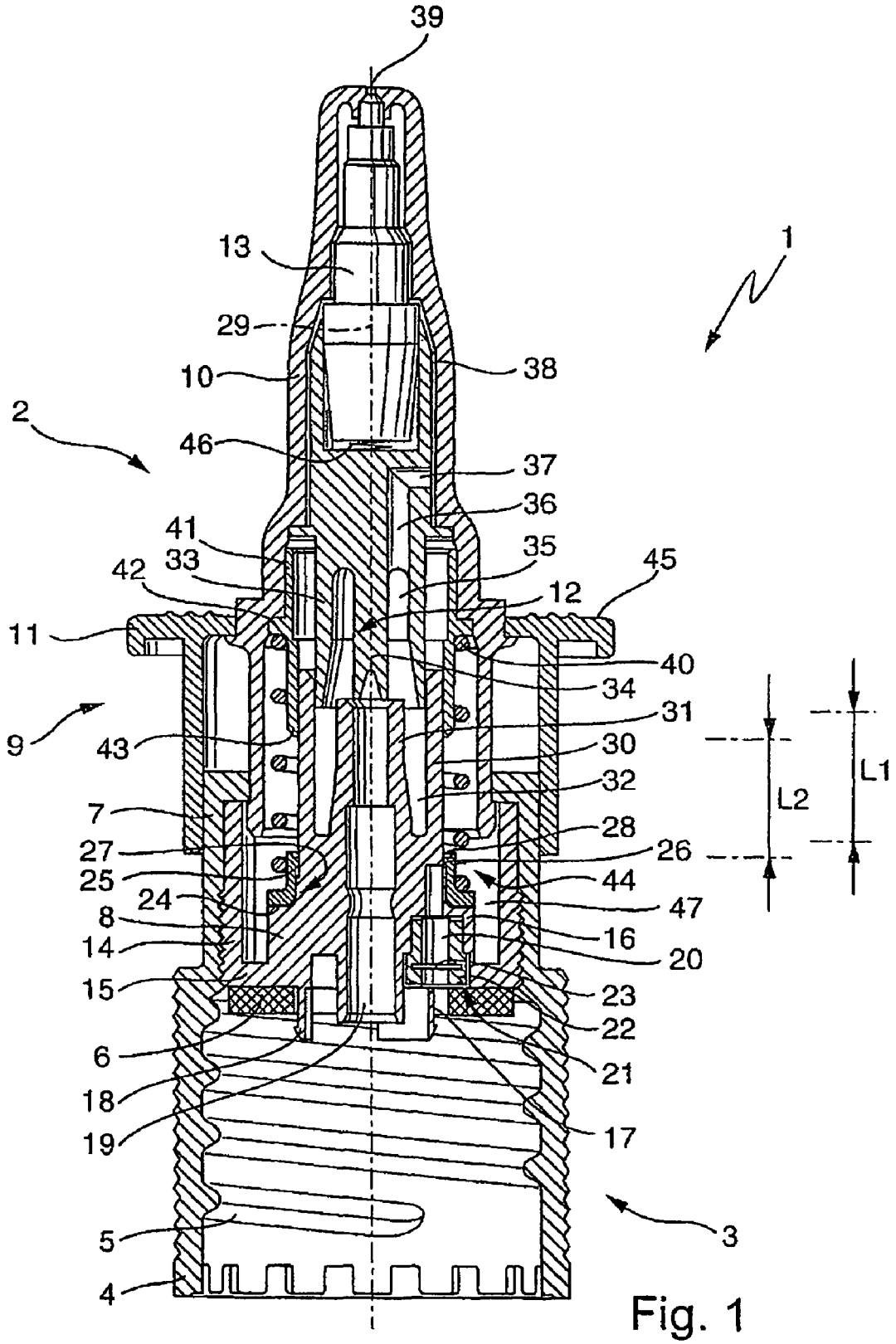
FIG. 1 shows, in a plane cross-sectional view, a metering device with a control member and a venting valve.

The metering device 1 shown in FIG. 1 comprises a pumping system 2 and a medium storage unit (which is not shown). The medium storage unit, which can be produced in particular as a plastic or glass container, can be mounted on an interface 3 of the pumping system 2. For a secure connection between medium storage unit and pumping system 2, the interface 3 has a receiving sleeve 4 which, by means of an inner thread 5 and a flat seal 6, permits a form-fit and leaktight engagement of a correspondingly shaped neck portion of the medium storage unit. The receiving sleeve 4 is designed integrally with a rotationally symmetrical guide sleeve 7 in which a lower part 8 of a piston pump 9 is received. An upper part 10 of the piston pump 9 is designed as a nasal adapter and is received in the guide sleeve 7 in such a way as to be movable relative to the lower part 8. The upper part 10 is assigned a handle 11, a piston group 12 and a valve body 13.

The lower part 8 has a substantially rotationally symmetrical design and comprises an outer sleeve 14 which is connected to a pump section 16 by way of a circumferential radial web 15. On an end face of the pump section 16 directed toward the interface 3, an annular retaining section 17 is provided which, at its end face, has a wedge geometry 18. The retaining section 17 is provided for form-fit engagement of the flat seal 6 that rests flat on the end face of the pump section 16. The wedge geometry 18 holds the flat seal 6 in the intended position, even when no medium storage unit is fitted. In the end face of the pump section 16, a centrally arranged through-bore 19 is provided for receiving an ascending pipe (not shown) that protrudes into the medium storage unit. The end face of the pump section 16 also has an eccentrically arranged venting bore 20 which provides a seat for a filter system 21 and is intended to permit a communication between the medium container and the environment of the pumping system 1. The filter system 21 is composed principally of a rotationally symmetrical filter sleeve 22, which has a continuous bore, and of a filter membrane 23 which is received in the filter sleeve 22 in such a way that it closes the continuous bore. The filter membrane 23 is made from a gas-permeable and liquid-impermeable material and thus permits the retention of microbes on a surface directed away from the medium storage unit and an escape of liquid and/or powdered constituents from the medium storage unit.

The venting bore 20 opens out, tangentially on an outer surface of the pump section 16 above an annular shoulder 24, into an intermediate space 47 which is in communication with the environment. The venting bore 20 is closed by a tubular cuff 25 which rests on the annular shoulder 24 and which is applied elastically onto the outer surface of the pump section. The tubular cuff 25 is rotationally symmetrical, produced from an elastic material, for example an elastomer such as silicone or polyethylene, and has a substantially L-shaped cross section. A shorter arm of the L-shaped cross section is arranged radially and rests with its inner face on the cylindrical outer face of the pump section 16, while an end face of the shorter arm directed toward the medium storage unit rests flat on the annular shoulder 24. On an inner face of the longer arm of the L-shaped cross section, there is a sealing lip 26 which is directed radially inward toward the outer face of the pump section 16 and which also rests on the outer face of the pump section 16. The sealing lip 26 has a small contact surface relative to the pump section, such that, even at a low contact force caused by the elastic deformation of the tubular cuff 25, there is a high degree of surface pressure on the inner surface of the sealing lip 26. A particularly advantageous sealing action of the tubular cuff 25 for the venting bore 20 can be achieved in this way. To permit an advantageous sealing action of the tubular cuff 25, the pump section 16 has a jump in diameter 27 at approximately half the height of the tubular cuff 25. The jump in diameter 27 ensures that only the sealing lip 26 rests on the outer face of the pump section 16 and can deploy the desired sealing action, while the rest of the longer arm of the L-shaped cross section stands free. On an end face of the tubular cuff 25 directed away from the medium storage unit, there is a conical circumferential control surface 28 designed as a conical ring surface, and a wedge angle of the control surface 28 relative to the pump axis 29 is configured as an acute angle. The tubular cuff 25 forms with the pump section 16, and with the venting bore 20 provided therein, the venting valve 44 of the metering device 1.

The pump section 16 is designed as a double sleeve in an area directed away from the medium storage unit. An inner wall of an outer sleeve 30 and an outer wall of an inner sleeve 31 delimit an annular chamber 32, which serves as cylinder for the piston pump 9. The outer sleeve 30 extends above the inner sleeve 31. The inner sleeve 31 forms the upper portion of the through-bore 19 directed away from the medium storage unit and has a conical configuration in the area of the end face.

The piston group 12 is basically designed as a one-piece, rotationally symmetrical structural part and comprises a piston sleeve 33 and a piston stamp 34 arranged concentrically with respect to the piston sleeve 33. At its end face, the piston stamp 34 is provided with a conical depression which increases the elasticity in this area and permits advantageous adaptation to the diameter of the through-bore 19. The piston sleeve 33 and the piston stamp 34 delimit a substantially annular piston chamber 35 which is shaped corresponding to the annular chamber 32. In a starting position, as is shown in FIG. 1, the piston sleeve 33 protrudes into the outer sleeve 30, while the piston stamp 34 ends at least approximately flush with an upper edge of the inner sleeve 31, but does not touch this, with the result that the through-bore 19 in the starting position is not closed and permits a connection to the ascending pipe (not shown) and thus to the medium storage unit. On the bottom of the piston chamber 35, an outlet bore 36 is provided which is eccentric to the pump axis 29 and which opens into a radially extending transverse bore 37. The transverse bore 37 forms a connection to an annular gap 38 which is formed between the piston group 12, the valve body 13 and the upper part 10 and which opens out in a nozzle orifice 39 introduced into the upper part 10 and communicating with the environment. In the starting position according to FIG. 1, the nozzle orifice 39 is kept closed by the valve body 13 pretensioned by a compression spring 46.

Between the upper part 10 and the lower part 8, there is a helical spring 40 which is designed as a compression spring and which holds the upper part 10 in the starting position. The helical spring 40 rests, via the shorter arm of the L-shaped tubular cuff 25, on the circumferential annular shoulder 24 of the lower part 8 and, at its other end, it rests on an intermediate sleeve 41 which is received with a form fit in the upper part 10. The intermediate sleeve 41 has a substantially hollow-cylindrical cross section and is provided with a radially outwardly directed, circumferential support collar 42, which permits a form-fit support on an annular shoulder of the upper part 10. On an end face of the intermediate sleeve 41 directed away from the upper part 10, a conical-ring surface is provided which tapers conically at an acute angle relative to the pump axis 29 and which is designed as a corresponding control surface 43 for the control surface 28. The intermediate sleeve 41 represents the control member of the pumping system and is mounted on the upper part 10 designed as the actuating part.

As is shown in FIG. 1, a relative mobility of the upper part 10 in relation to the lower part 8 in the starting position is achieved by an excursion-limiting means for which a circumferential, radially outwardly directed annular collar 43 is provided on the upper part and, in the starting position, is in a form-fit operative engagement with a radially inwardly directed collar of the guide sleeve 7 and prevents the upper part 10 from sliding out of the lower part 8. The piston sleeve 33 driven into the annular chamber 32 during a pump stroke limits the relative mobility upon actuation of the metering device. According to FIG. 1, the pump stroke takes place as L1. By contrast, the distance of the control surface 28 of the tubular cuff 25 from the control surface 43 of the intermediate sleeve is L2. The distance L1 is greater than the distance L2, with the result that, when the pump executes a full stroke, the venting valve 44 is necessarily actuated by the intermediate sleeve 41 designed as control member.

The handle 11, which has a rotationally symmetrical design and has finger placement surfaces 45, is mounted with a form fit on the upper part 8. The handle 11 slides on the outer face of the guide sleeve 7 and thereby stabilizes the stroke movement of the upper part 10 relative to the lower part 8.

Figure 2:
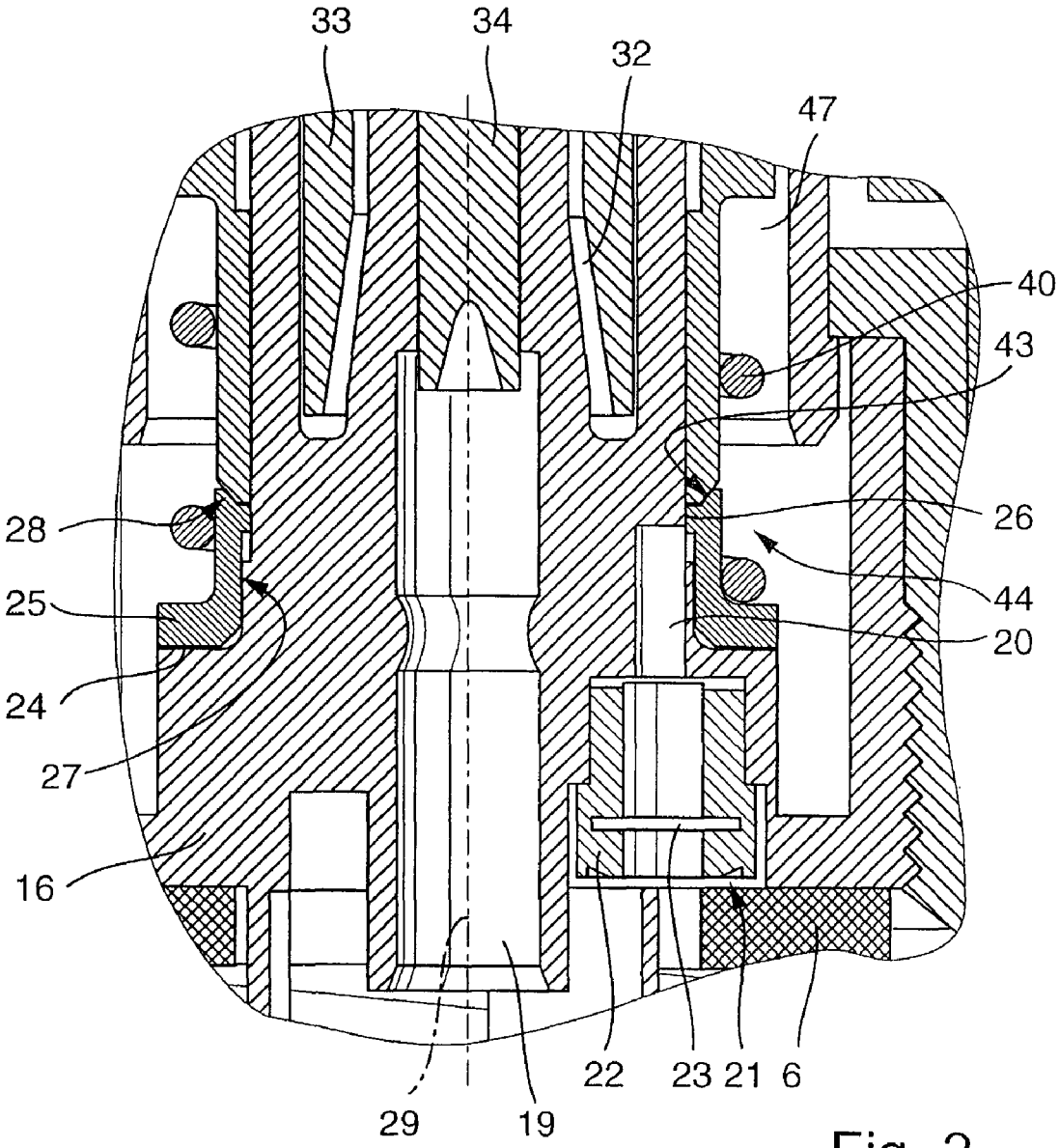
FIG. 2 shows, in a plane cross-sectional view, an enlarged detail of the metering device according to FIG. 1.

To actuate the metering device 1, a user applies oppositely directed operating forces to the finger placement surfaces 45 and to the base of the medium storage unit (not shown). As soon as the operating forces exceed a force level predetermined by a pretensioning of the helical spring 40, a movement of the upper part 10 and of the structural parts connected to it takes place. The piston group 12 with the piston sleeve 33 and the piston stamp 34 slides into the annular chamber 32 and into the through-bore 19. The piston sleeve 33 forms, with the annular chamber 32, an outer limit for a volume of medium. The movement of the upper part 10 means that the piston stamp 34, which is flush with the upper edge of the inner sleeve in the starting position, comes into contact with the through-bore 19 provided in the inner sleeve 31 and closes said through-bore 19, such that the annular chamber 32 and the piston chamber 35 formed by the piston sleeve 33 and by the piston stamp 34 close off the volume of medium. The enclosed volume of medium, subjected to pressure by the operating force, can therefore escape only through the outlet bore 36, the transverse bore 37, the annular gap 38 and the nozzle orifice 39. However, since the valve body 13 closes the nozzle orifice, the volume of medium has to be placed under sufficient pressure in order to exert an opening force on the valve body 13 counter to the pretensioned compression spring 46. This can be achieved by increasing the actuating force applied by the user, such that the volume of medium is placed under increasing pressure and, finally, exerts the opening force on the valve body 13, with the result that an escape into the environment is permitted. This then causes a drop in pressure in the enclosed volume, which leads to a rapid movement of the piston group 12 in the direction of the medium storage unit. In the course of this movement, the control surface 43 of the intermediate sleeve 41 approaches the control surface 28 of the tubular cuff 25. Finally, as is shown in FIG. 2, the opposite control surfaces 28 and 43 make contact, whereupon the longer arm of the L-shaped cross section of the tubular cuff 25 is forced radially outward by the conical-ring contour of the opposite control surfaces 28 and 43. In this way, the sealing lip 26 is lifted from the outer surface of the pump section 16 and frees the venting bore 20. This means that ambient air can flow in through the venting bore 20 and the filter system 21 provided therein, such that a partial or complete pressure equalization is permitted between the environment and the medium storage unit. After completion of the discharge of the medium through the nozzle orifice 39, the operator reduces the operating force again, such that the upper part 10 moves back toward the starting position, under the effect of the helical spring 40 deformed during the actuating process. The intermediate sleeve 41 also moves away from the tubular cuff 25, such that the control surfaces 28 and 43 are no longer in contact with one another and the tubular cuff 25, by virtue of its elasticity, closes the venting opening 20 again. In this way, no further gas exchange can take place between the volume enclosed in the medium storage unit and the environment.

Because of the forced control of the venting valve 44 via the intermediate sleeve 41, the elasticity of the tubular cuff 25 can be chosen such that escape of readily volatile constituents of the medium from the medium storage unit can take place only at a high overpressure. This ensures that the venting valve is closed under normal storage conditions and application conditions, with the result that no change takes place in the concentration of the active substance contained in the medium storage unit.

In an embodiment of the invention not shown here, the intermediate sleeve is mounted on the lower part so as to be movable relative thereto and to embody a time delay member. Compared to the embodiment shown in FIGS. 1 and 2, the helical spring for restoring the upper part to the starting position is not supported on the intermediate sleeve, but instead directly on the upper part, while the intermediate sleeve is pressed against the upper part by a second compression spring provided concentrically with respect to the helical spring. The compression spring is supported on the tubular cuff and on the underside of the support collar. In contrast to the embodiment in FIGS. 1 and 2, the intermediate sleeve is designed to be displaceable relative to the upper part. An operating force exerted on the upper part can be introduced into the intermediate sleeve via the support collar. A displacement of the intermediate sleeve is effected, as in the embodiment in FIGS. 1 and 2, by a movement of the upper part in the direction of the medium storage unit. The intermediate sleeve can slide on the outer face of the pump section in order to be moved from a starting position to an actuating position for the venting valve. In the actuating position, the control surfaces of the intermediate sleeve and of the tubular cuff come into operative connection, whereupon the sealing lip is forced radially outward by the interaction of the conical-ring surfaces and, in this way, is lifted from the surface of the pump section. When the upper part moves back to the starting position after completion of the discharging operation, the intermediate sleeve does not therefore immediately follow this movement, because there is no rigid coupling between upper part and intermediate sleeve. Rather, the intermediate sleeve is pressed back into the starting position only by the elastic force of the compression spring, which was compressed during the actuation, this movement taking place counter to a defined frictional force that arises between the outer face of the pump section and the inner face of the intermediate sleeve. The outer face of the pump section and/or the inner face of the intermediate sleeve are provided, at least in some parts, with a damping medium, for example a silicone coating, which slows down a sliding movement of the intermediate sleeve, from the actuating position back to the starting position, as a result of corresponding frictional forces. This has the effect that the intermediate sleeve moves back more slowly into the starting position than the upper part, with the result that the venting valve can also still be open when the upper part has already returned to the starting position.

Figure 3:
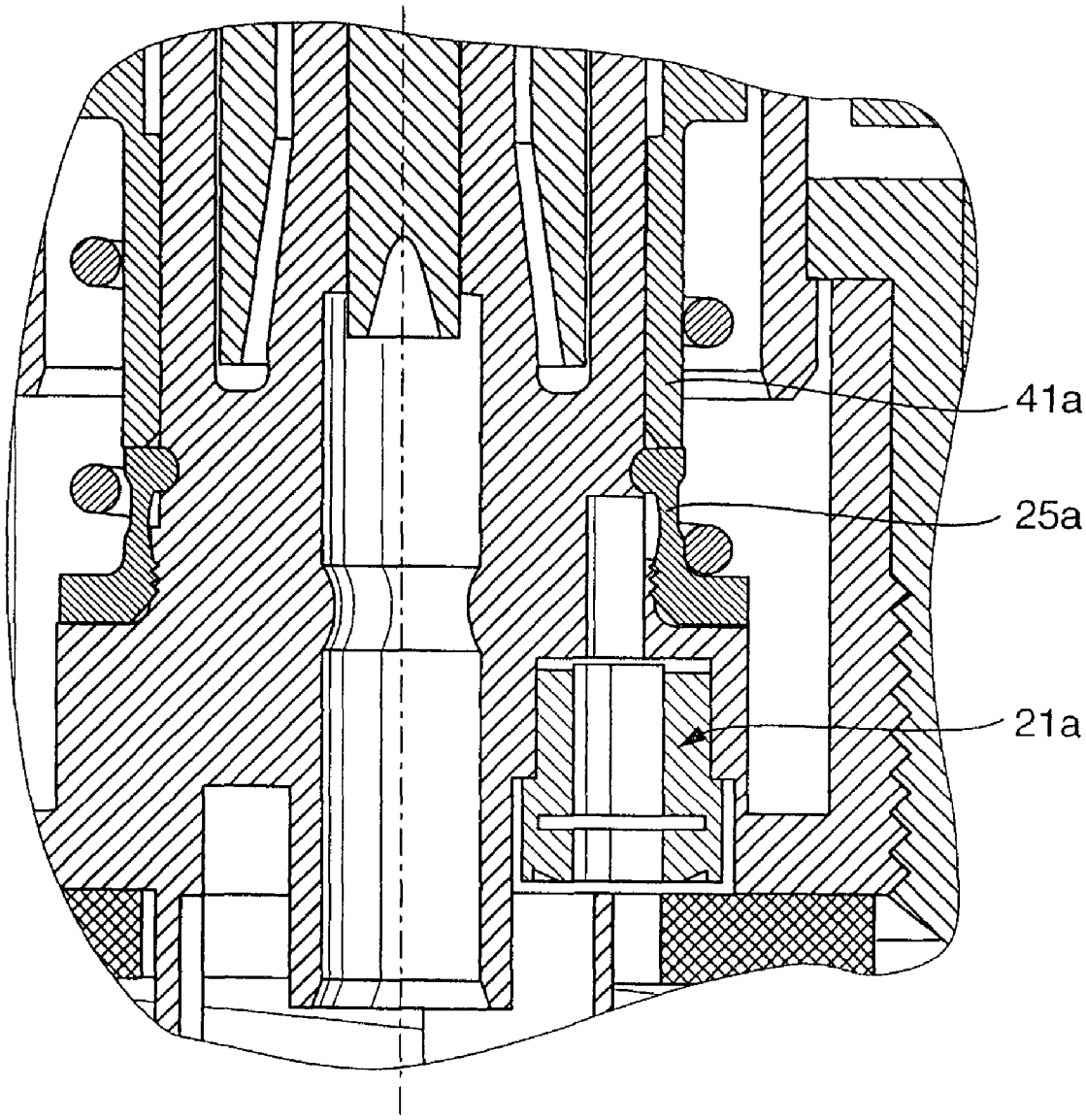
FIG. 3 shows an enlarged detail of another embodiment of a metering device.
Figure 4:
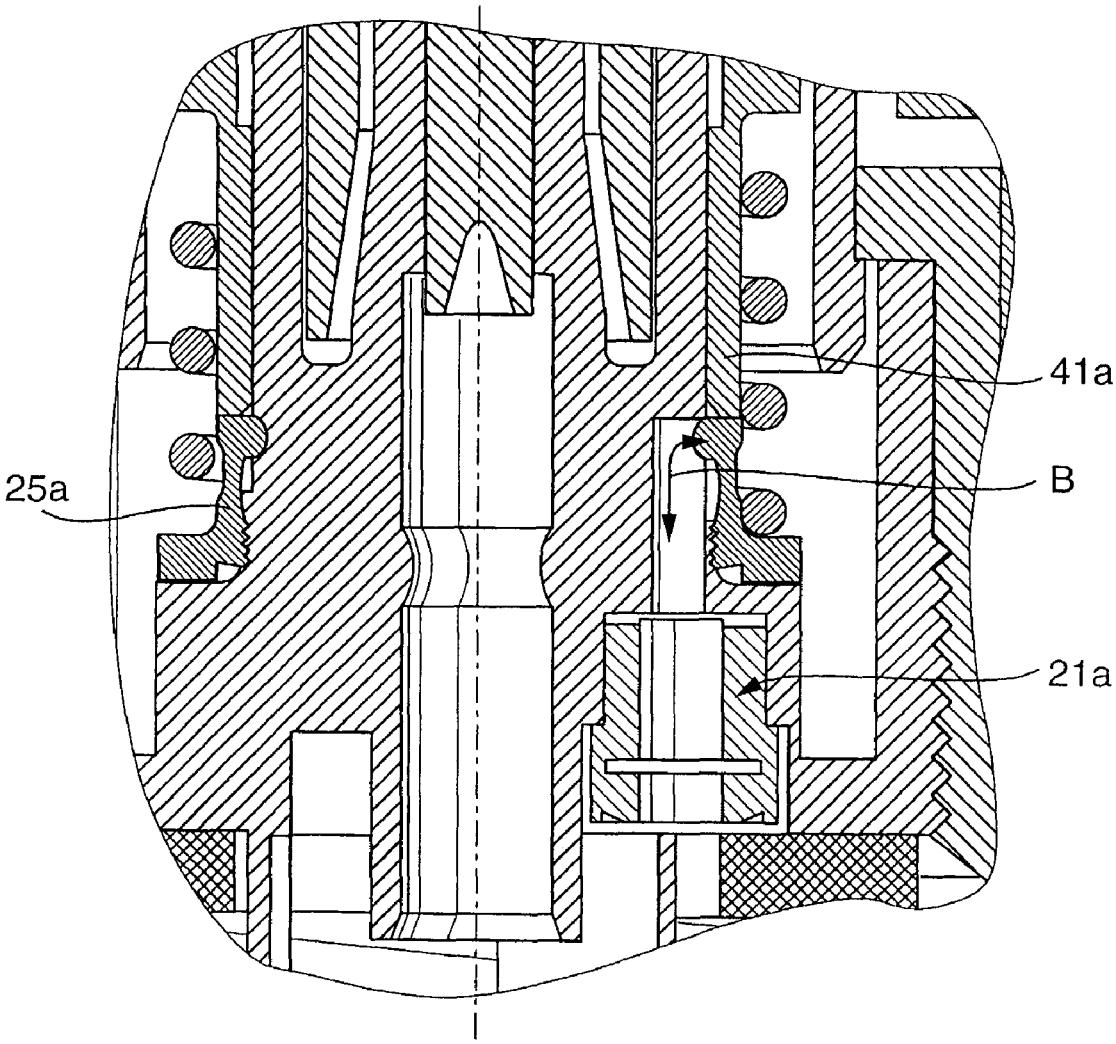
FIG. 4 shows the configuration according to FIG. 3 with the venting valve opened.

The embodiment according to FIGS. 3 and 4 corresponds substantially to the above-described embodiment of a metering device. Accordingly, reference is here made expressly to the disclosure concerning the metering device according to FIGS. 1 and 2, so as to avoid repetitions. The differences from the embodiment according to FIGS. 1 and 2 are set out below. For improved clarity, structural parts having the same functions are provided with the same reference numbers with addition of the letter "a".

The main difference in the embodiment according to FIGS. 3 and 4 is that the venting valve in the form of the tubular cuff 25*a* is not subjected to an outwardly opening radial component by the intermediate sleeve 41*a* designed as control member, but is simply moved axially downward. The valve-closing position of the tubular cuff 25*a* is shown in FIG. 3. FIG. 4 shows the valve-opening position. It will be seen from the latter figure that, in the valve-opening position, the tubular cuff 25*a* is elastically compressed and deformed, and is thus shifted axially downward with its sealing lip section. The corresponding axial loading arises from the lower end face of the intermediate sleeve 41*a* coming into contact with a correspondingly plane surface of the tubular cuff 25*a* oriented radially with respect to the pump axis: By means of the elastic compression of the tubular cuff 25*a*, a venting path B is freed which, in the unloaded and upright state of the tubular cuff 25*a*, is closed by its circumferential sealing lip (FIG. 3). The filter system designated by 21*a* in FIGS. 3 and 4 corresponds to the filter system 21 of the embodiment according to FIGS. 1 and 2, such that no further details of this need be given here.

The invention claimed is:

1. A metering device for at least one medium, with a medium storage unit, and with a pumping system connected to the medium storage unit, said medium storage unit or said pumping system comprising a venting valve that is held in the closed position by elastic force, wherein a control member is assigned to the venting valve in such a way that the control member opens the venting valve in the event of a pumping movement of the pumping system, wherein the venting valve and the control member are provided with mutually corresponding control surfaces that are brought into contact with one another for opening the venting valve, wherein the venting valve comprises a tubular cuff which, coaxially with respect to a pump axis, encloses a rotationally symmetrical pump section, and wherein the control surfaces are oriented at an inclination with respect to the pump axis in such a way that, during a pumping movement, a radial movement component directed outward from the pump axis is applied to the tubular cuff to open the venting valve.

2. The metering device as claimed in claim 1, wherein the control member is arranged on an actuating part which belongs to the pumping system and which is movable in a reciprocating motion relative to the venting valve, and in that the venting valve, in an unloaded state of the pumping system, is arranged at an axial distance from the control member relative to the pump axis, that is smaller than an actuating stroke of the actuating part.

3. The metering device as claimed in claim 1, wherein the control surfaces are formed by mutually facing conical-ring surfaces arranged on the actuating part of the pumping system and on the tubular cuff.

4. A metering device for at least one medium comprising:

a pumping system connected to a medium storage unit, said pumping system comprising a piston pump including a rotationally symmetrical pump section having a pump axis;

a venting valve comprising an elastic tubular cuff having a tubular cuff control surface, the tubular cuff being disposed coaxially with respect to the pump axis and enclosing the pump section, the tubular cuff being elastically maintained in a closed position at rest to seal a radially opening venting bore formed within the pump section; and a control member axially spaced from the tubular cuff and having a control member control surface, the control member being axially movable in the event of a pumping movement of the pumping system, wherein the control member control surface and the tubular cuff control surface are oriented at an inclination with respect to the pump axis, and wherein a pumping movement of the pumping section axially moves the control member so that the control member control surface contacts the tubular cuff control surface in such a way that a radial movement component directed outward from the pump axis is applied to the elastic tubular cuff to open the venting bore.

5. The metering device as claimed in claim 4, wherein the control member control surface and the cuff control surface are formed by mutually facing conical-ring surfaces, the control member comprising an actuating part of the pumping system.

6. The metering device as claimed in claim 4, wherein the control member is arranged on an actuating part of the pumping system and is movable in a reciprocating manner relative to the tubular cuff, and in an unloaded state of the pumping system, the control member is spaced an axial distance from the tubular cuff.

7. The metering device as claimed in claim 4, wherein the control member has an inner face in contact with an outer sleeve of the pump section.

8. The metering device as claimed in claim 4, wherein the tubular cuff includes a sealing lip defining an L-shaped cross section, the sealing lip contacting an annular shoulder of a lower part of the piston pump.

9. The metering device as claimed in claim 8, wherein the inclination of the tubular cuff control surface of the tubular cuff is inclined at an acute angle, with an outer edge of the cuff control surface projecting outwardly and upwardly from an inner edge of the cuff control surface disposed in contact with the pump section.

* * * * *